US005921043A

United States Patent [19]

McDonald

[11] Patent Number: 5,921,043

[45] Date of Patent: Jul. 13, 1999

[54] PREFABRICATED, ENCLOSED BUILDING

[75] Inventor: Harley C. McDonald, Omaha, Nebr.

[73] Assignee: Composite Structures, Inc., Omaha, Nebr.

[21] Appl. No.: 08/921,156

[22] Filed: Aug. 29, 1997

[51] Int. Cl.[6] ..... E04H 1/00; E04C 2/00

[52] U.S. Cl. ..... 52/309.9; 52/79.1; 52/404.1; 52/309.11

[58] Field of Search ..... 52/79.1, 404.1, 52/309.9, 309.11

[56] References Cited

U.S. PATENT DOCUMENTS

| | | | |
|---|---|---|---|
| 3,122,860 | 3/1964 | Schulze | 52/309.11 |
| 3,496,689 | 2/1970 | Nerem | 52/309.11 X |
| 3,778,582 | 12/1973 | Heifetz et al. | 174/48 |
| 3,905,167 | 9/1975 | Watkins et al. | 52/79 |
| 3,949,528 | 4/1976 | Hartger et al. | 52/79 |
| 3,968,989 | 7/1976 | Schippers | 296/29 |
| 4,033,081 | 7/1977 | Perkins, Jr. | 52/263 |
| 4,071,984 | 2/1978 | Larrow | 52/79.1 |
| 4,075,798 | 2/1978 | Tazaki | 52/404.1 X |
| 4,078,348 | 3/1978 | Rothman | 52/309.11 X |
| 4,269,006 | 5/1981 | Larrow | 52/79.1 |
| 4,288,962 | 9/1981 | Kavanaugh | 52/743 |
| 4,700,514 | 10/1987 | Reineman | 52/86 |
| 4,726,707 | 2/1988 | Newton | 52/309.11 X |
| 4,774,794 | 10/1988 | Grieb | 52/309.7 |
| 4,832,308 | 5/1989 | Slomimsky et al. | 52/309.11 X |
| 5,285,617 | 2/1994 | Romig et al. | 52/79.1 X |
| 5,315,794 | 5/1994 | Pearson | 52/79.1 |
| 5,345,738 | 9/1994 | Dimakis | 52/309.9 |
| 5,473,849 | 12/1995 | Jones, Jr., et al. | 52/424 |
| 5,512,345 | 4/1996 | Tsutsumi et al. | 52/404.1 X |
| 5,556,498 | 9/1996 | Blanchard | 156/245 |
| 5,755,062 | 5/1998 | Slater | 52/79.1 |

*Primary Examiner*—Christopher Kent
*Assistant Examiner*—Brian E. Glessner
*Attorney, Agent, or Firm*—Zarley, McKee, Thomte Voorhess & Sease; Dennis L. Thomte

[57] ABSTRACT

A building constructed of a molded fiberglass inner shell having a molded fiberglass outer shell positioned thereover to create a space therebetween which is filled with a foam core material. Each of the inner and outer shells include upstanding walls and a roof extending thereover. The inner and outer shells are provided with registering door openings formed therein into which a door is mounted. A pair of differently designed floors may be utilized in the building. Further, the floor may be omitted if desired. The outer surface of the outer shell has a smooth finish as does the inner surface of the inner shell.

17 Claims, 6 Drawing Sheets

PREFABRICATED, ENCLOSED BUILDING

BACKGROUND OF THE INVENTION

1. Field of the Invention

This invention relates to a building and more particularly to a building including an inner fiberglass shell having a larger outer fiberglass shell positioned thereover with the space therebetween being filled with a urethane foam material or the like.

2. Description of the Related Art

Many small buildings have been previously constructed of fiberglass for use in toxic or corrosive conditions. For example, small fiberglass buildings have been used to enclose chemical injection pumps, etc. Conventional fiberglass buildings usually include a shell comprised of fiberglass. The outside surface of the building wall is normally constructed by the hand lay-up process on an open mold. This creates a smooth outer wall surface. Successive layers of glass and resin laminate are added to the mold surface until the desired thickness is achieved. In some cases, a foam core material is added between the laminate layers to provide additional thickness for increased stiffness and to provide insulation in the wall itself. This process produces a textured or rough interior surface as compared to the smooth outer surface. The textured or rough interior surface is also crude in appearance. Although the previous building panels and buildings constructed thereof have been somewhat successful, the rough surface at the interior of the building makes it difficult to clean.

SUMMARY OF THE INVENTION

A building is disclosed which includes a one-piece outer shell having upstanding walls and a roof extending thereover. A one-piece inner shell is positioned inside the outer shell and includes upstanding walls and a roof extending thereover. The inner shell is spaced from the outer shell to define a space therebetween. The shells are joined with a bonding compound at the floor mounting flanges thereon as well as the door frame edges. Liquid urethane foam resin is pressure-injected into the space between the inner and outer shells. The foam resin expands to completely fill the space between the walls and, in the process, bonds to the walls joining the inner and outer shells into a single unitary structure consisting of outer and inner fiberglass reinforced plastic skins and a structural foam inner core which serves to strengthen the building structure and provide an insulated wall of exceptional strength, beauty and thermal resistivity. One of the walls of the outer shell has a door opening formed therein with one of the walls of the inner shell also having a door formed therein which registers with the door opening in the outer shell. A door is positioned in the registering door openings. The inside surface of the inner shell is smooth to facilitate the cleaning thereof.

It is therefore a principal object of the invention to provide an improved building.

Still another object of the invention is to provide a building which is ideally suited for use in toxic or corrosive conditions.

Still another object of the invention is to provide a building comprising a one-piece outer shell having a one-piece inner shell positioned therebetween with the space therebetween filled with a polyurethane foam material for joining, strengthening, and insulating the structure.

Still another object of the invention is to provide a fiberglass building having a smooth inside surface.

Still another object of the invention is to provide a building which, once the inner and outer shells are joined, forms a single unitary structure with no interior or exterior seams that are exposed to the weather or can be penetrated by escaping gases or liquids within the building.

These and other objects will be apparent to those skilled in the art.

DESCRIPTION OF THE PREFERRED EMBODIMENT

Figure 1:
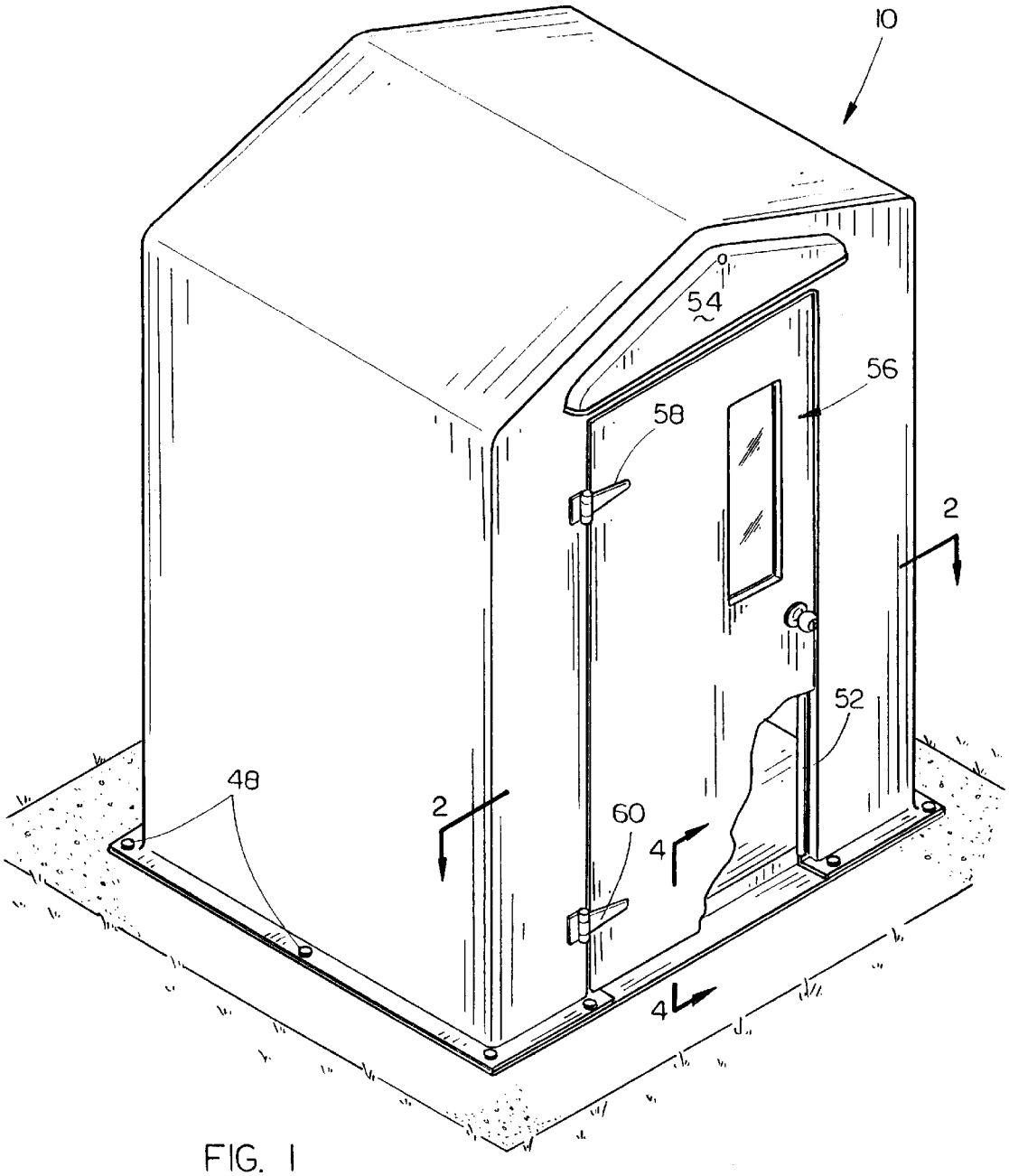
FIG. 1 is a perspective view of the building of this invention.

The building of this invention is referred to generally by the reference numeral 10 which includes an inner shell 12 of molded fiberglass material and an outer shell 14 also of molded fiberglass material. The inner and outer shells 12 and 14 are substantially identical in design, with a few exceptions as will be described hereinafter, except that inner shell 12 is smaller than outer shell 14 to create a space 16 which is provided therebetween and which is filled with a polyurethane foam core material 18 for strengthening and insulating purposes.

It should be noted that the foam core material 18 may be of several different types of phenalic foam for high fire resistance.

Inner shell 12 includes a front wall 20 having a door opening 22 formed therein, side walls 24 and 26, back wall 28, peaked roof 30 and a horizontally extending base flange 32. Similarly, outer shell 14 includes a front wall 34 having a door opening 36 formed therein, side walls 38 and 40, back wall 42 and peaked roof 44. Outer shell 14 is provided with a base flange 46 at its lower end which is adapted to rest upon base flange 32. The flanges 32 and 46 are welded together with an epoxy bonding compound to form a single unitary structure. Flanges 32 and 46 are secured to a suitable floor or slab by anchor bolts 48 extending therethrough.

Figure 6:
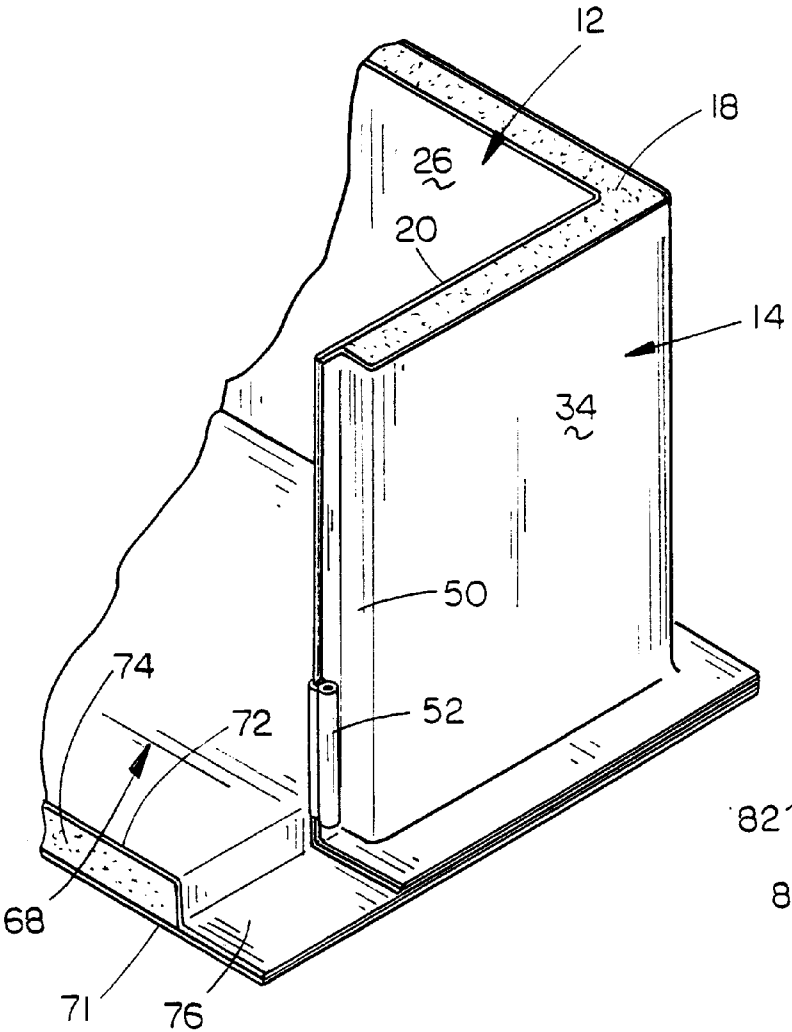
FIG. 6 is a partial perspective view illustrating the floor of FIG. 4.

As seen in FIG. 6, front wall 34 of outer shell 14 is provided with an angular shoulder portion 50 so that the wall 34 around the door opening 36 will be closely adjacent wall 20 so that a weather stripping material 52 may be positioned on the adjacent edges thereof.

Figure 2:
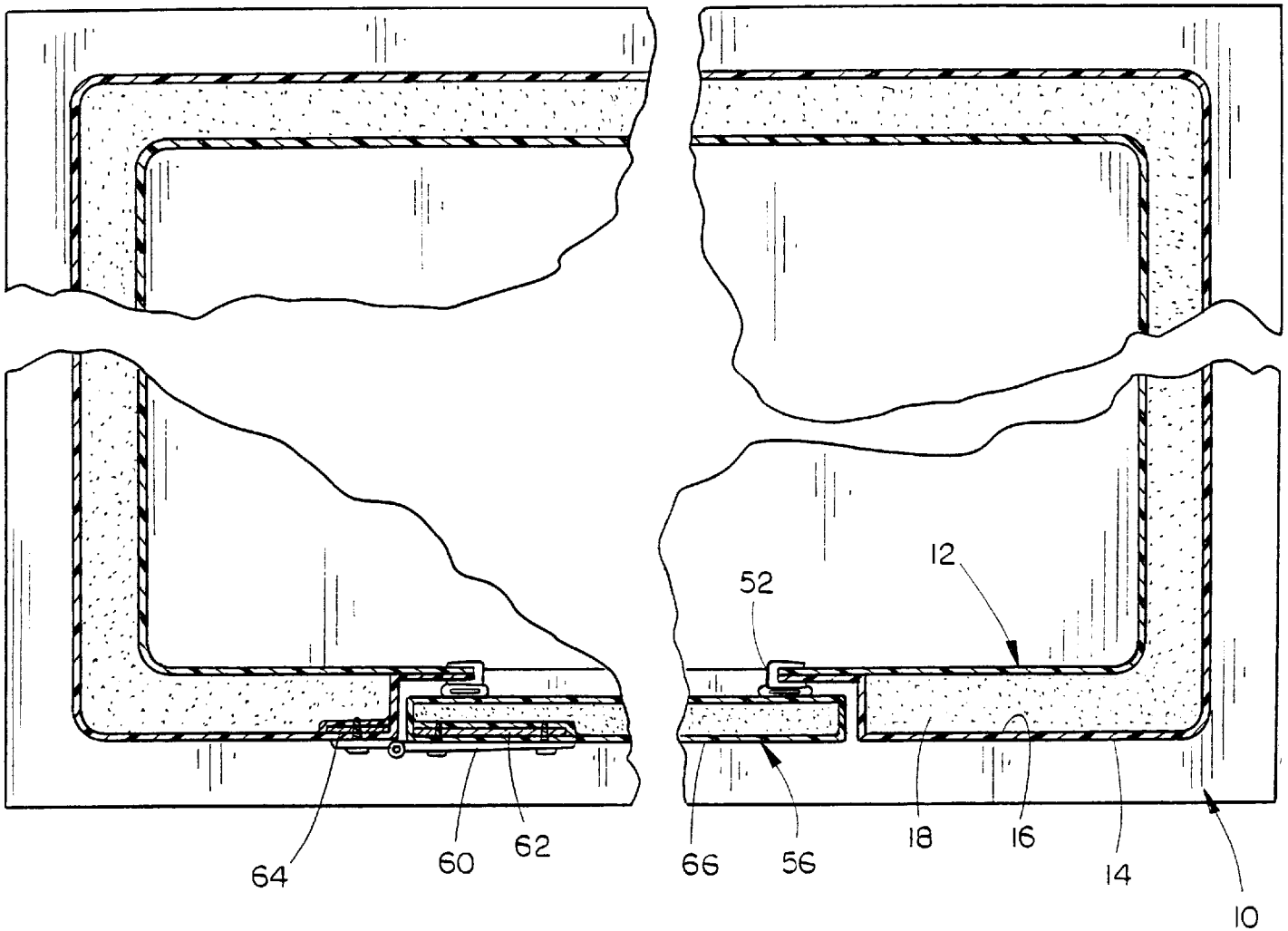
FIG. 2 is a partial sectional view seen on lines 2—2 of FIG. 1.

The numeral 54 refers to a rain cap which is positioned on the front wall 34 of outer shell 14 above the door opening 36. The numeral 56 refers to a door which is hingedly secured to outer shell 14 by hinges 58 and 60. Preferably, a pair of metal reinforcing plates 62 are provided in the door 56 at the hinge edge thereof to enable the hinges 58 and 60 to be secured thereto, as illustrated in FIG. 2. Also, outer shell 14 is provided with a pair of vertically spaced metal reinforcing plates 64 provided therein to enable the hinges 58 and 60 to be secured thereto. Door 56 is also preferably hollow and is filled with a foam core material referred to generally by the reference numeral 66. As seen in FIG. 2, when the door 56 is closed, the weather stripping material 52 is compressed to seal the door opening.

Figure 3:
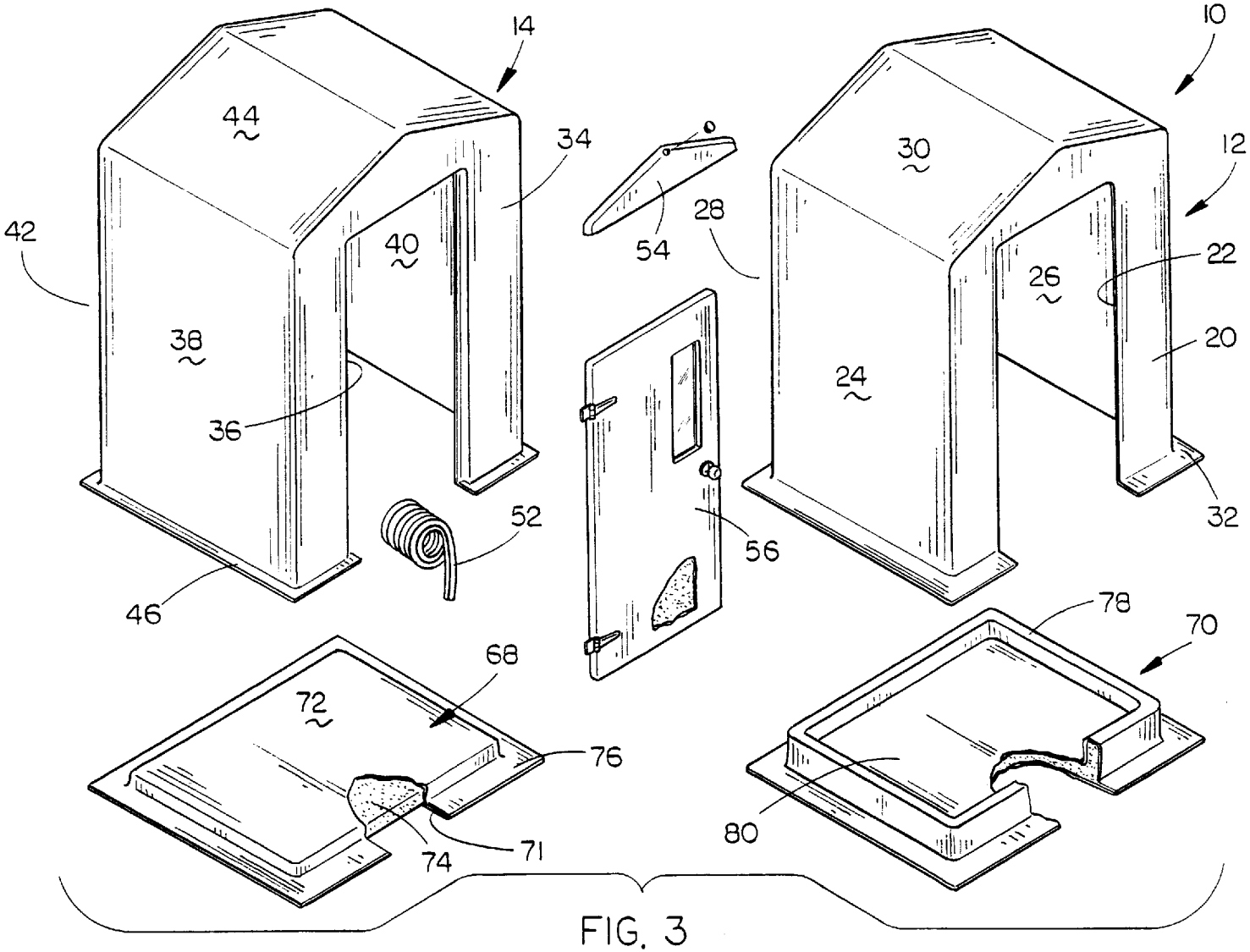
FIG. 3 is an exploded perspective view of the building also illustrating a pair of optional floors therefore having portions thereof cut away to more fully illustrate the invention.
Figure 5:
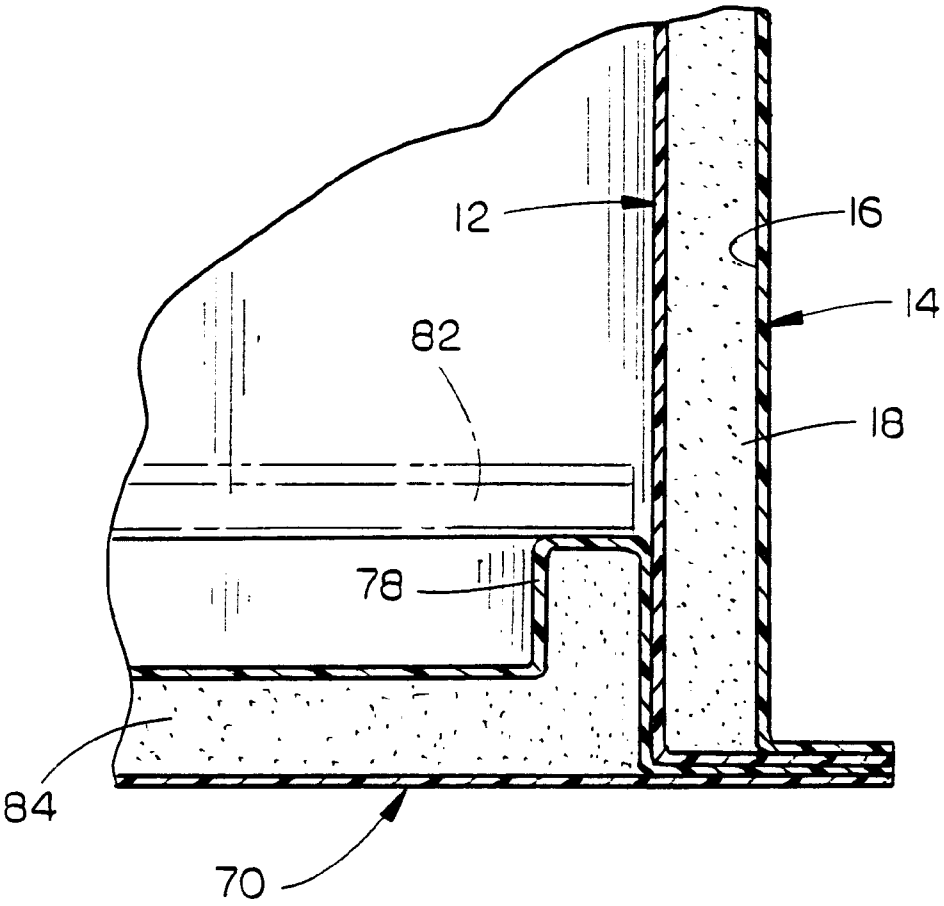
FIG. 5 is a view similar to FIG. 4 except that a different type of floor is utilized for the building.
Figure 4:
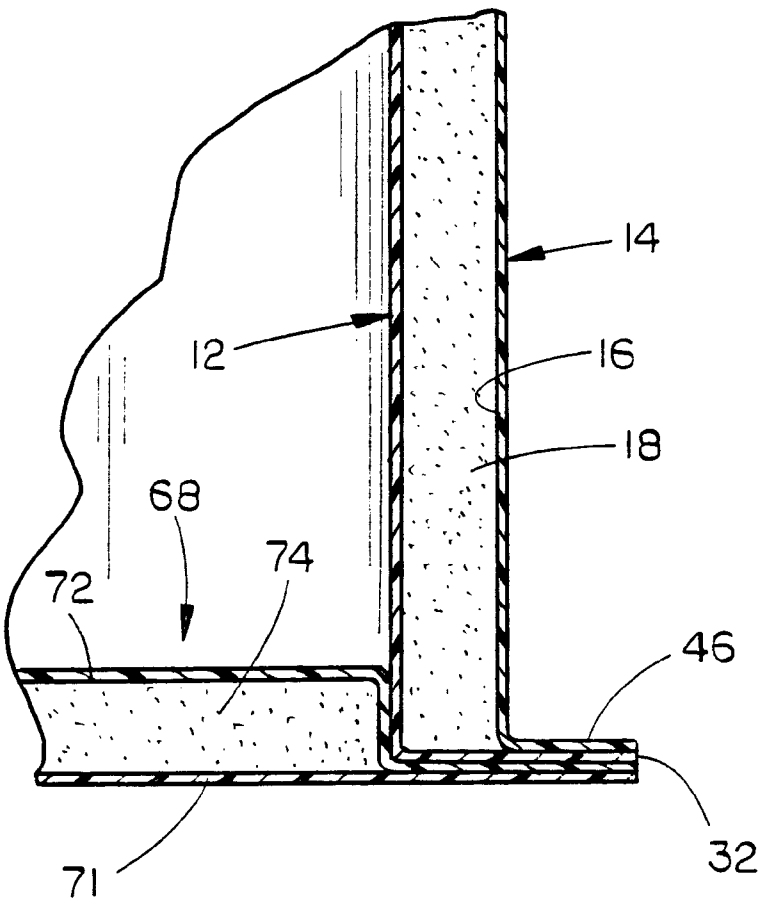
FIG. 4 is a partial sectional view seen on lines 4—4 of FIG. 1.

The building 10 may be constructed without a floor, but it is preferred that a floor be utilized. FIG. 3 illustrates a pair of different floors which may be utilized with the building 10 and which are referred to by the reference numerals 68 and 70, respectively. Floor 68 is molded of a two-piece fiberglass material to include a bottom wall 71 and a top wall 72 having a space therebetween which is filled with urethane foam core material, in the same manner as the inner and outer shells, and referred to generally by the reference numeral 74. The periphery of floor member 68 is formed to provide a base 76 which receives the flanges 46 and 32 of the shells 14 and 12 thereon, respectively. The seam between walls 71 and 72 is welded together with an epoxy bonding compound. The shells 12 and 14 are joined to the floor 68 with an epoxy bonding compound to produce a single unitary flange equal to four skin thicknesses to provide an exceptionally strong anchorage flange for resisting wind and earthquake loading.

Figure 7:
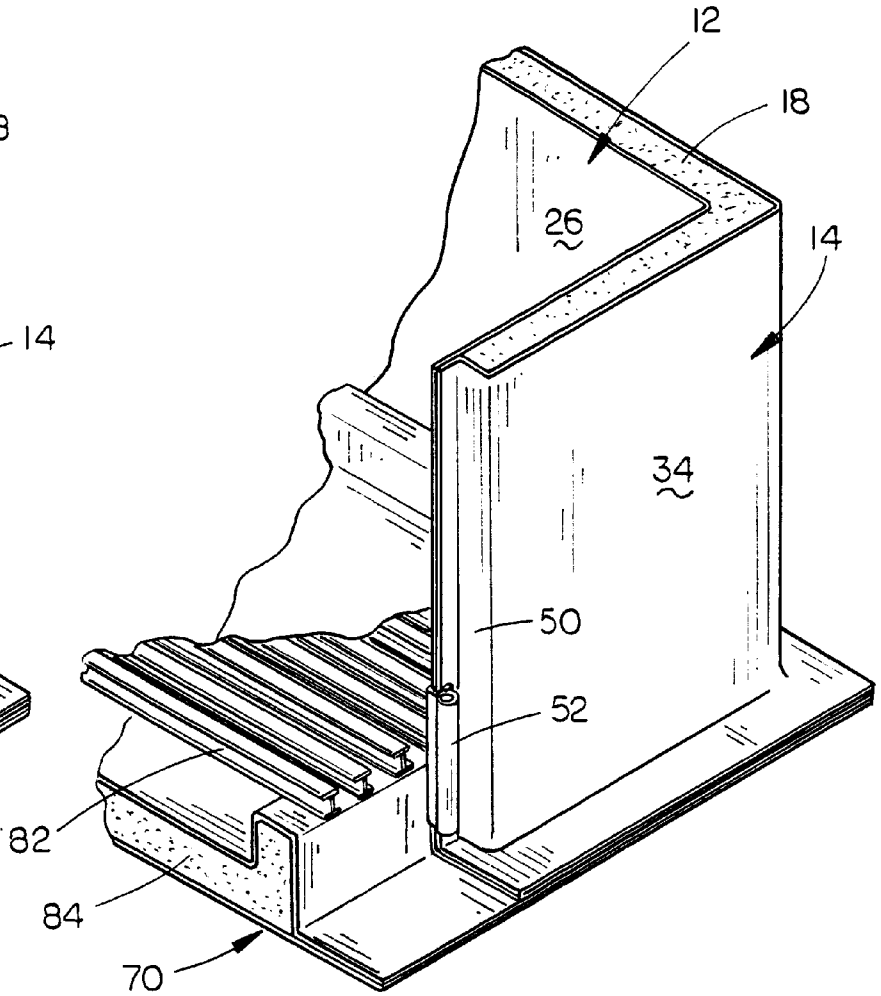
FIG. 7 is a perspective view similar to FIG. 6 except that the floor of FIG. 5 is utilized.

Floor member 70 is somewhat different in design than floor member 68 in that it is designed to provide a support shoulder 78 which extends upwardly from the floor, as illustrated in FIG. 3, to create a collection basin 80. Spaced-apart support members or grating members 82 may be extended across the support shoulder 78, as illustrated in FIG. 7, for supporting equipment thereon while providing a collection basin area therebelow to collect hazardous liquids spilled from the equipment within the building. Floor 70 is also filled with a urethane foam core material 84, as illustrated in FIGS. 3 and 7.

Figure 8:
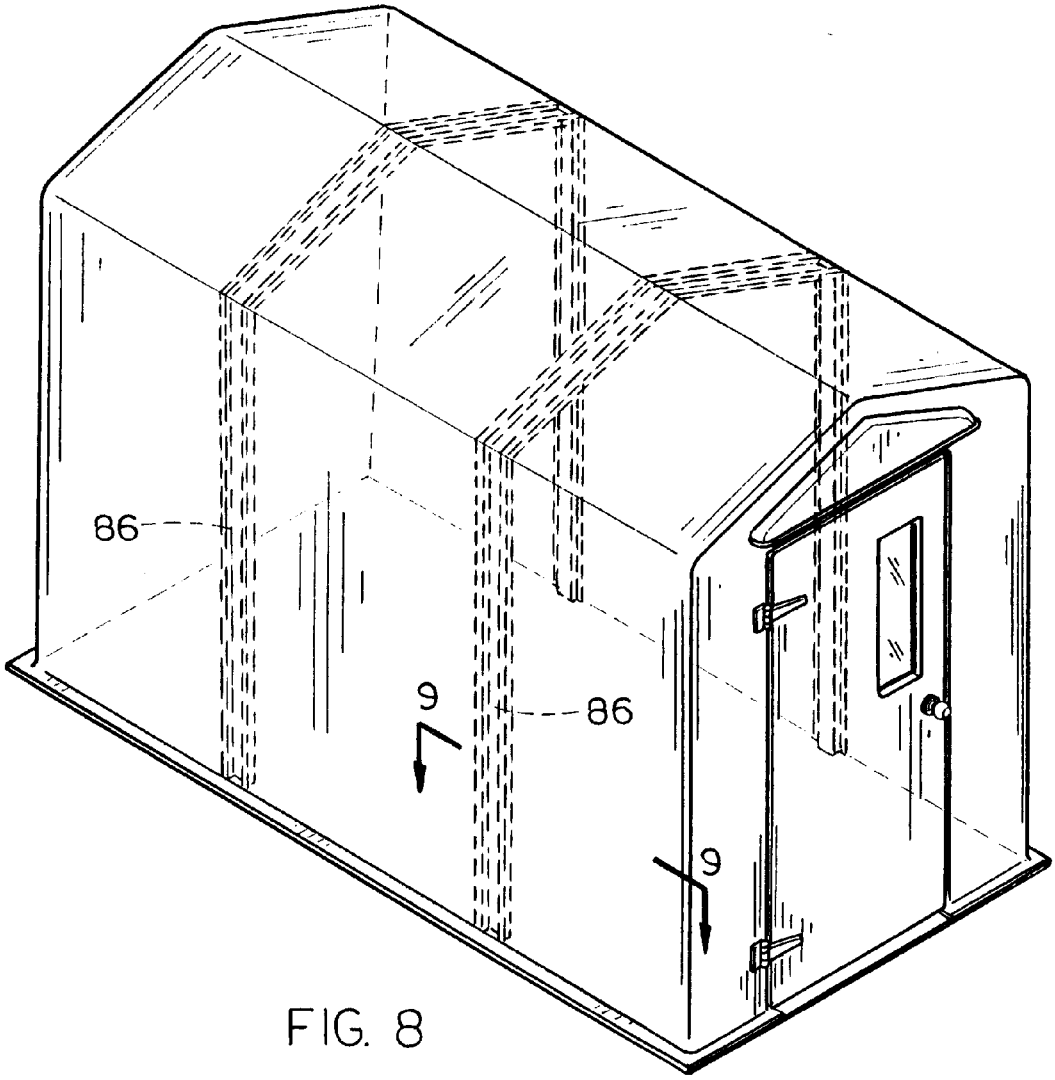
FIG. 8 is a perspective view of the building illustrating optional strengthening braces provided between the inner and outer shells.
Figure 9:
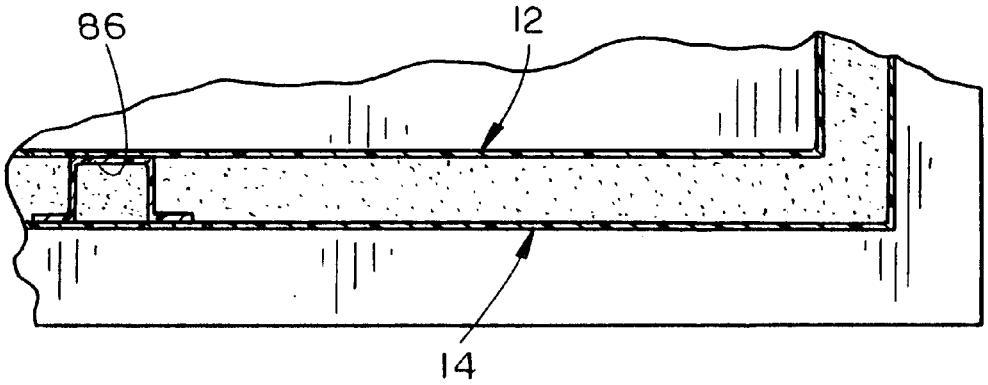
FIG. 9 is a sectional view seen on lines 9—9 of FIG. 8.

If a building is to be created which has a depth or length greater than can be stably supported by the inner shell, outer shell, and foam core construction previously described, it is recommended that strengthening members, such as hot channel shaped support ribs 86, be positioned in the space between the outer shell 14 and the inner shell 12, as illustrated in FIGS. 8 and 9. The support ribs 86 are also formed from a molded fiberglass material. The support ribs 86 are chemically bonded to inner shell 12 and outer shell 14.

Thus it can be seen that a unique building has been provided which is comprised of a molded fiberglass inner shell 12 having a molded fiberglass outer shell 14 positioned thereover so as to define a space therebetween which is filled with a urethane foam core material to add strength to the structure as well as providing insulation for the building. Since the outer shell 14 is comprised of a molded fiberglass material, it will have a smooth outer surface. Further, inasmuch as inner shell 12 is comprised of a molded fiberglass material, the inside surface thereof will be smooth to facilitate cleaning thereof. Further, the smooth inner surface of the inner shell 12 overcomes the potential for any voids in the laminate, penetration of gases or liquids, and the resultant potential for delamination. Further, the building is free from seams on its inner and outer surfaces, thereby creating a structure that, with proper seals at the doors, can be made gas and liquid tight, making it ideal for chemical feed stations and the storage of hazardous material.

Thus it can be seen that the invention accomplishes at least all of its stated objectives.

I claim:

1. A prefabricated, enclosed building, comprising:

an outer shell of one-piece, seamless construction including upstanding front and back walls of one-piece seamless construction and a roof extending thereover;

an inner shell of one-piece, seamless construction positioned inside of said outer shell including upstanding front and back walls of one-piece seamless construction and a roof extending thereover;

said inner shell being spaced from said outer shell to define a space therebetween;

strengthening means in said space between said outer and inner shells for strengthening the building;

one of said walls of said outer shell having a door opening formed therein;

one of said walls of said inner shell having a door opening formed therein which registers with said door opening in said outer shell;

and a door positioned in said registering door openings.

2. The building of claim 1 wherein said strengthening means comprises a foam core material injected into said space.

3. The building of claim 1 wherein said strengthening means comprises a foam core insulation material.

4. The building of claim 1 wherein said outer shell has a smooth outer surface.

5. The building of claim 4 wherein said inner shell has a smooth inner surface.

6. The building of claim 1 wherein said inner shell of one-piece, seamless construction and said outer shell of one-piece, seamless constuction are comprised of a molded fiberglass material.

7. The building of claim 6 wherein said door is comprised of a molded fiberglass material.

8. The building of claim 1 wherein a floor member is positioned in said building which is bonded to said inner and outer shells.

9. The building of claim 8 wherein said floor member is comprised of an upper wall member and a bottom wall member having a space therebetween which is filled with a foam core material.

10. The building of claim 9 wherein said upper wall member has an upstanding support shoulder which defines a collection basin.

11. The building of claim 10 wherein spaced-apart floor grating members are positioned on said support shoulder.

12. The building of claim 1 wherein said walls of said inner and outer shells include a front wall, opposite side walls, and a back wall, and wherein spaced-apart strengthening members are positioned in the space between the side walls of said inner and outer shells and between said roofs of said inner and outer shells.

13. The building of claim 12 wherein each of said strengthening members is of one-piece construction.

14. The building of claim 1 wherein the lower end of each of said walls has an outwardly projecting anchoring flange.

15. The building of claim 1 wherein said strengthening means joins said inner and outer shells together.

16. A prefabricated, enclosed building, comprising:

a one-piece outer shell including upstanding front and back walls of one-piece, seamless construction and a roof extending thereover;

a one-piece inner shell positioned inside of said outer shell including upstanding front and back walls of one-piece, seamless construction and a roof extending thereover;

said inner shell being spaced from said outer shell to define a space therebetween;

strengthening means in said space between said outer and inner shells for strengthening the building;

one of said walls of said outer shell having a door opening formed therein;

one of said walls of said inner shell having a door opening formed therein which registers with said door opening in said outer shell;

and a door positioned in said registering door openings.

17. The building of claim 12 wherein said strengthening members are chemically bonded to said inner and outer shells.

* * * * *